US009817352B2

(12) United States Patent
Tsukamura

(10) Patent No.: US 9,817,352 B2
(45) Date of Patent: Nov. 14, 2017

(54) IMAGE FORMING APPARATUS AND CONTROL METHOD FOR DRAWING A TONER PATCH

(71) Applicant: KONICA MINOLTA, INC., Tokyo (JP)

(72) Inventor: Shinichi Tsukamura, Uenohara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/875,598

(22) Filed: Oct. 5, 2015

(65) Prior Publication Data

US 2016/0124364 A1 May 5, 2016

(30) Foreign Application Priority Data

Oct. 29, 2014 (JP) ..... 2014-220332

(51) Int. Cl.
*G03G 15/00* (2006.01)

(52) U.S. Cl.
CPC ..... *G03G 15/5058* (2013.01); *G03G 15/5054* (2013.01)

(58) Field of Classification Search
CPC . G03G 21/00; G03G 15/5058; G03G 15/5054
See application file for complete search history.

(56) References Cited

U.S. PATENT DOCUMENTS 5,153,658 A * 10/1992 Lundy ..... G03G 21/0035 15/1.51
5,463,455 A * 10/1995 Pozniakas ..... G03G 21/0011 399/350
5,826,139 A * 10/1998 Nacman ..... H04N 1/4076 347/900
6,775,511 B2 * 8/2004 Kosuge ..... G03G 21/0005 399/346
6,856,772 B2 * 2/2005 Bessho ..... G03G 15/0131 399/101

(Continued)

FOREIGN PATENT DOCUMENTS

JP 2000-206744 7/2000
JP 2003-076079 3/2003

(Continued)

OTHER PUBLICATIONS

Machine translation of JP 2013113879 A.*

(Continued)

*Primary Examiner* — David Bolduc
(74) *Attorney, Agent, or Firm* — Squire Patton Boggs (US) LLP

(57) ABSTRACT

An image forming apparatus supplies, to an image carrying member, a toner to which a lubricant is externally added to form a toner image and transfers the toner image to a sheet transported to the image carrying member. The image forming apparatus includes a control portion that controls, when a toner patch is formed onto the image carrying member in a part corresponding to a region between the sheets transported continuously, the drawing of the toner patch based on coverage information of the toner image transferred to the sheet transported in a predetermined period.

14 Claims, 5 Drawing Sheets

(56) References Cited

U.S. PATENT DOCUMENTS 7,209,699 B2 * 4/2007 Yamaguchi ..... G03G 21/0094 399/111
7,302,203 B2 * 11/2007 Morimoto ..... G03G 15/168 399/101
8,095,059 B2 * 1/2012 Shintani ..... G03G 21/007 399/346
8,406,677 B2 * 3/2013 Kondo ..... G03G 15/0126 399/346
9,025,209 B2 * 5/2015 Ichinose ..... H04N 1/04 358/1.13
2005/0074264 A1 * 4/2005 Amemiya ..... G03G 21/0029 399/346
2006/0029405 A1 * 2/2006 Tanaka ..... G03G 15/556 399/27
2006/0045571 A1 * 3/2006 Matsuura ..... G03G 21/0064 399/149
2006/0269316 A1 * 11/2006 Kyung ..... G03G 15/0194 399/101
2007/0036575 A1 * 2/2007 Hamano ..... G03G 15/50 399/82
2007/0047992 A1 * 3/2007 Kubo ..... G03G 15/161 399/71
2007/0116483 A1 * 5/2007 Kobayashi ..... G03G 15/0131 399/49
2008/0013978 A1 * 1/2008 Facci ..... G03G 21/0011 399/71
2008/0075484 A1 * 3/2008 Komiya ..... G03G 15/5041 399/39
2009/0003865 A1 * 1/2009 Endou ..... G03G 15/0844 399/66
2009/0087206 A1 * 4/2009 Koide ..... G03G 15/161 399/71
2009/0129793 A1 * 5/2009 Milton ..... G03G 21/0011 399/38
2010/0046997 A1 * 2/2010 Gross ..... G03G 21/0011 399/346
2010/0080602 A1 * 4/2010 Taguma ..... G03G 21/00 399/71
2011/0013959 A1 * 1/2011 Thayer ..... G03G 21/0005 399/346
2011/0058832 A1 * 3/2011 Suzuki ..... G03G 15/0194 399/49
2011/0222885 A1 * 9/2011 Yamaki ..... G03G 15/0131 399/66
2011/0268463 A1 * 11/2011 Kimura ..... G03G 21/0005 399/53
2011/0268466 A1 * 11/2011 Kimura ..... G03G 15/757 399/71
2012/0134698 A1 * 5/2012 Nishisaka ..... G03G 15/161 399/66
2012/0134700 A1 * 5/2012 Yamaki ..... G03G 15/161 399/71
2012/0275807 A1 * 11/2012 Kanari ..... G03G 15/161 399/58
2013/0136471 A1 * 5/2013 Lawton ..... G03G 15/0126 399/49
2014/0169813 A1 * 6/2014 Seki ..... G03G 21/0041 399/45
2014/0340457 A1 * 11/2014 Hashimoto ..... G03G 21/0011 347/118
2015/0212457 A1 * 7/2015 Kanno ..... G03G 15/1675 399/66

FOREIGN PATENT DOCUMENTS

JP 2005-043388 2/2005
JP 2011007831 A * 1/2011
JP 2011-059454 A 3/2011
JP 2013-123869 A 6/2013
JP 2013113879 A * 6/2013

OTHER PUBLICATIONS

Machine translation of JP 2011007831 A.*
Japan Patent Office, Notification of Reasons for Refusal in Application No. 2014-220332, dispatched Nov. 10, 2016, with English translation; 7 pages.

* cited by examiner

[Fig. 1]
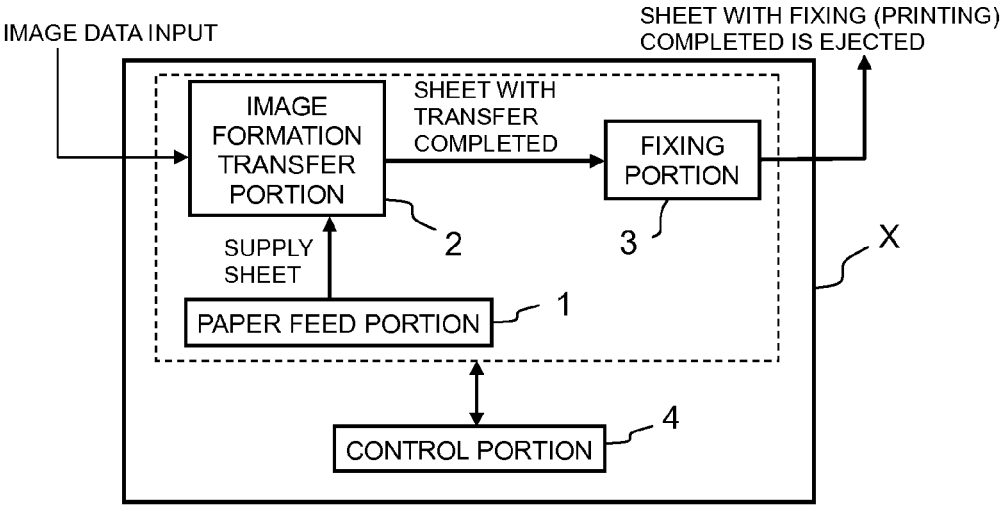
[Fig. 2]
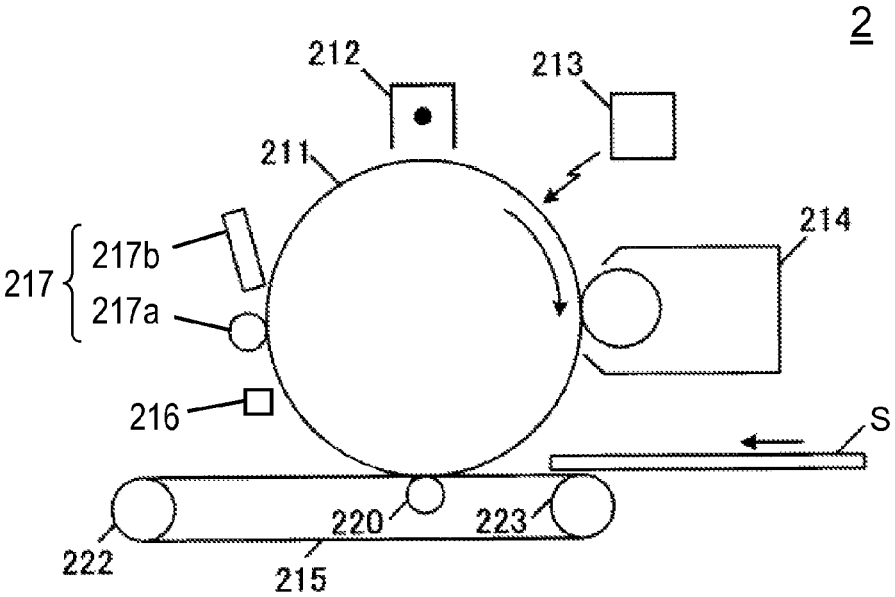

[Fig. 3]
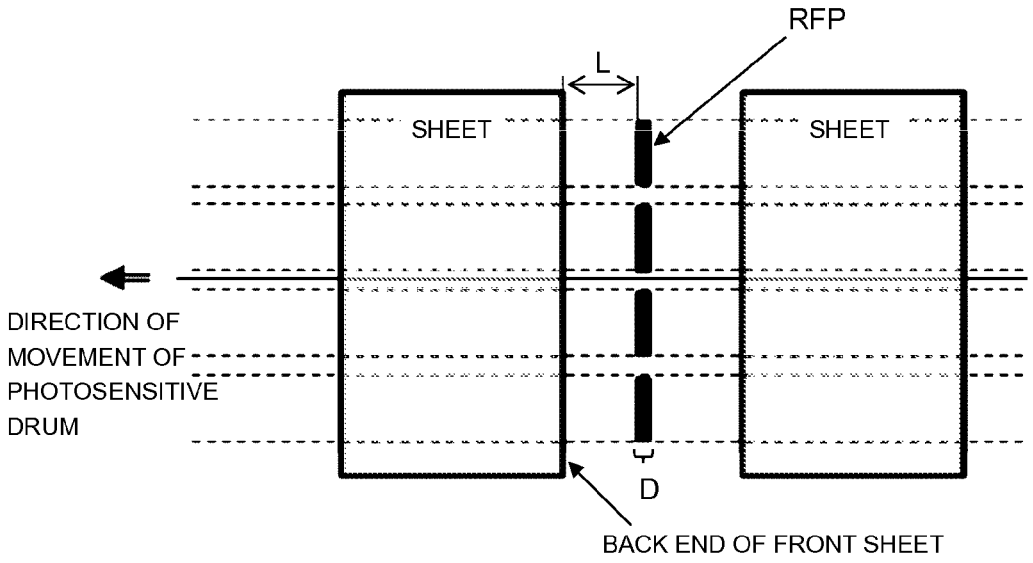
[Fig. 4]
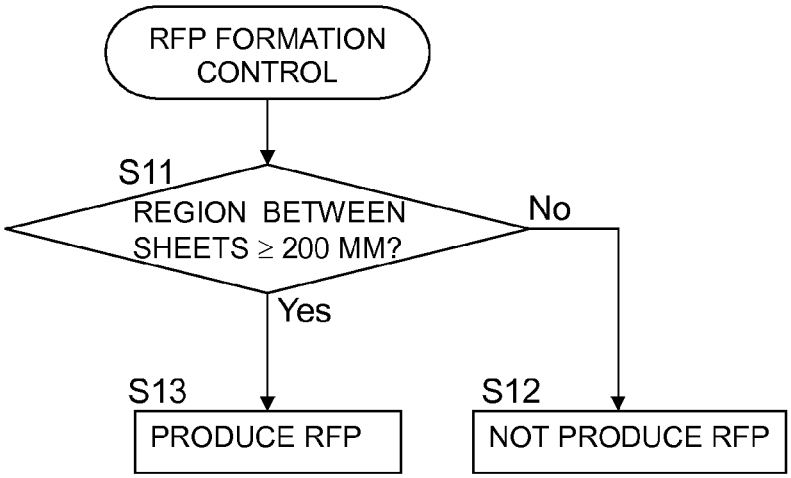

[Fig. 5]
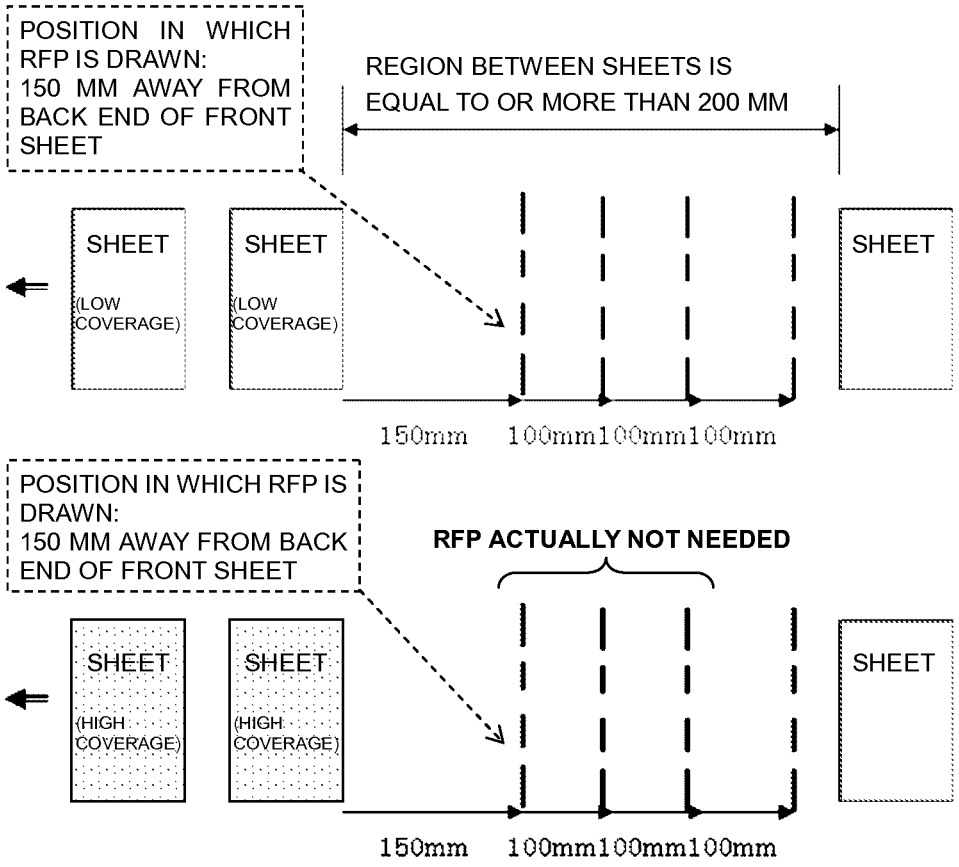

[Fig. 6]
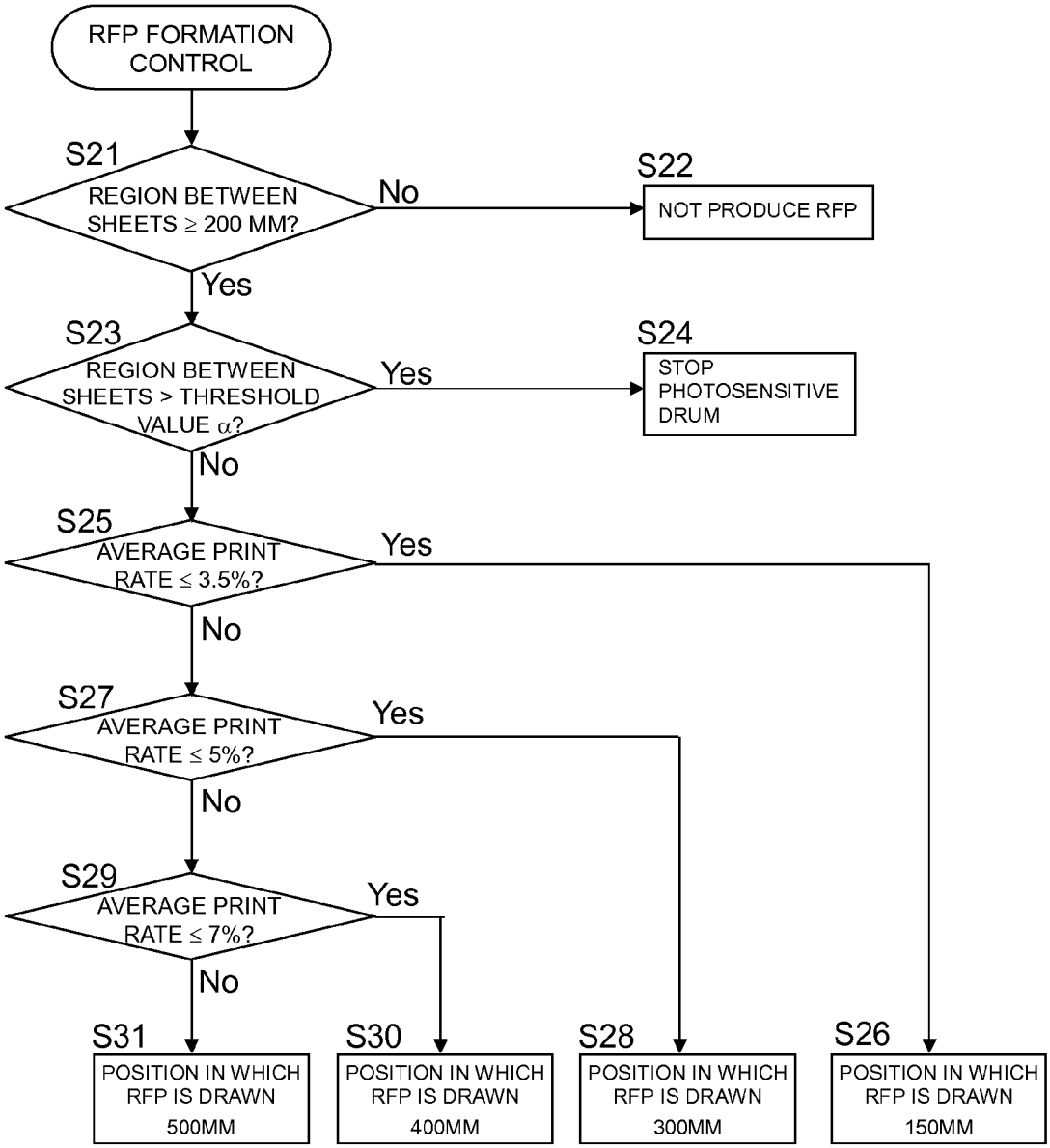

[Fig. 7]
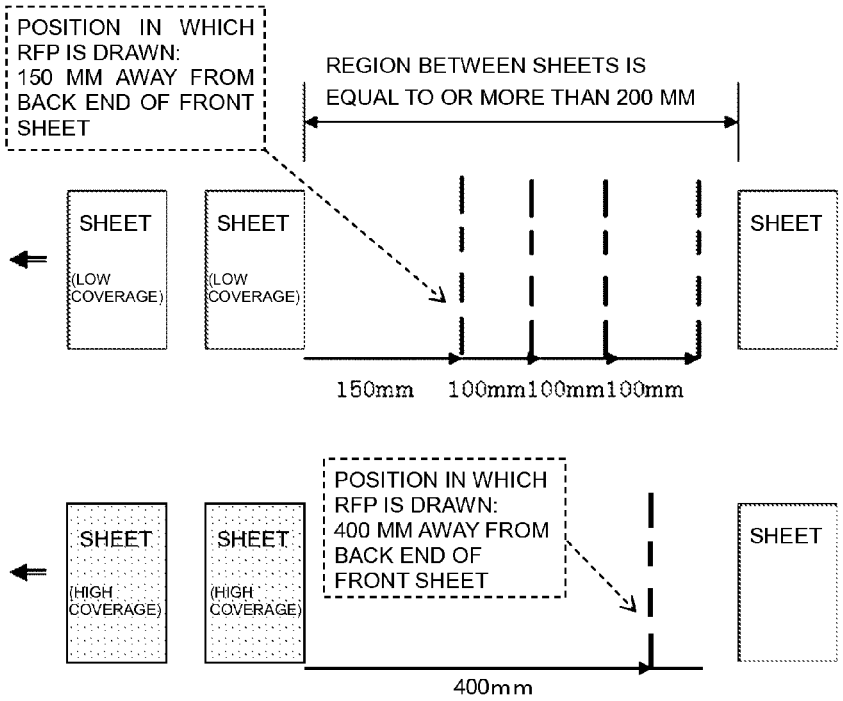
[Fig. 8]
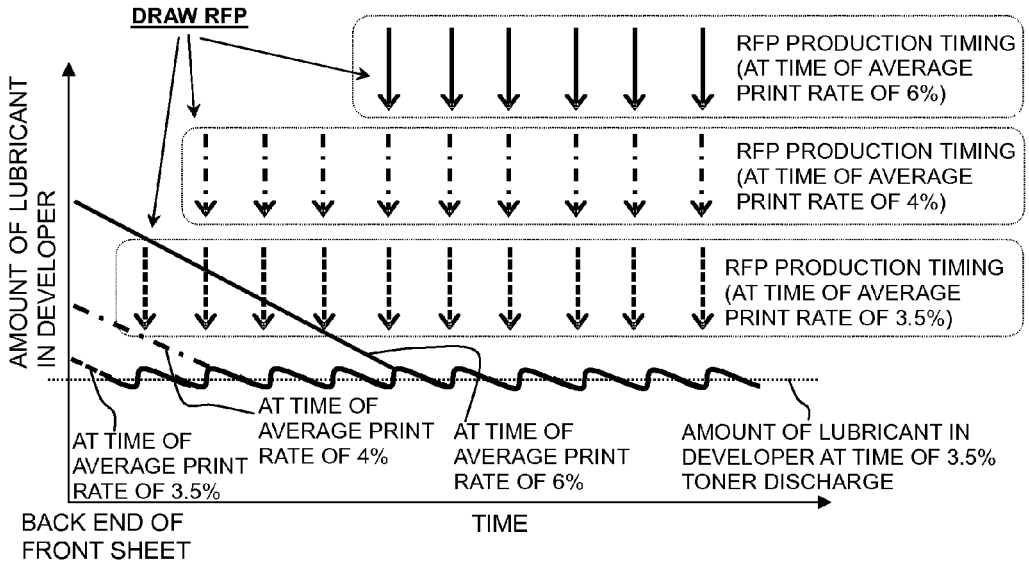

IMAGE FORMING APPARATUS AND CONTROL METHOD FOR DRAWING A TONER PATCH

This application is based on Japanese Patent Application No. 2014-220332 filed on Oct. 29, 2014 the contents of which are hereby incorporated by reference.

BACKGROUND OF THE INVENTION

Field of the Invention

The present invention relates to an image forming apparatus and a control method that is performed in an image forming apparatus.

Description of the Related Art

In general, in an image forming apparatus utilizing an electrophotographic process technology, laser light based on image data is applied to a charged photosensitive member to form an electrostatic latent image. Then, toner is supplied from a development device to the photosensitive member on which the electrostatic latent image is formed, and thus the electrostatic latent image is visualized to form a toner image. Furthermore, the toner image is transferred either directly or indirectly to a sheet and is then fixed by being heated and pressurized, and thus the image is formed on the sheet.

In the image forming apparatus described above, a blade or the like is brought into a sliding contact with the surface of the photosensitive member on which the toner image is formed, and thus attachments such as a residual toner attached to the surface of the photosensitive member are removed (cleaned). When the photosensitive member is cleaned with the blade or the like, in order to reduce an attachment force of the toner to the photosensitive member to enhance the cleaning performance, a technology is used in which the toner to which a lubricant is externally added is applied and the lubricant is attached to the surface of the photosensitive member.

It is known that the attached amount of lubricant on the surface of the photosensitive member greatly affects the cleaning performance. For example, when the attached amount of lubricant is decreased, since the residual toner or the like is easily attached to the surface of the photosensitive member, it becomes difficult to perform the cleaning, with the phenomenon that the toner is passed through or an edge part of the blade is drawn in the direction of movement (the direction of rotation) of the photosensitive member and is thereby turned up.

Here, the case where the attached amount of lubricant is decreased will be specifically described. The lubricant externally added to the toner has an opposite polarity (for example, a positive polarity) so as to be attached to the toner, and a large proportion of the lubricant is moved to a part (negatively charged white part) of the surface of the photosensitive member that is not exposed at the time of development.

Hence, when the image formation processing of low coverage (low print rate) is continuously performed, in a state where a small amount of toner is supplied to the development device, a large amount of lubricant is moved from the development device to the photosensitive member as compared with the toner, with the result that the lubricant in the development device may be exhausted. When the lubricant in the development device is exhausted, the lubricant to be attached to the photosensitive member runs out, and thus the amount of lubricant on the photosensitive member is gradually lowered, with the result that the phenomenon described above occurs.

Therefore, when the image formation processing of low coverage is performed, a low production-time forced discharge toner image (toner image by toner refresh patch control; in the present application, also referred to as the "RFP") is formed in a non-image formation region of the photosensitive member such that the toner to which the lubricant is externally added is newly supplied to the development device. In many cases, the RFP is a belt-shaped toner image.

The RFP is formed, and thus it is possible to avoid a possibility that the lubricant in the development device is exhausted and hence a possibility that the amount of lubricant on the photosensitive member is lowered. The non-image formation region of the photosensitive member refers to a region between image formation regions each formed by a toner image transferred to one sheet of paper, and generally refers to a "region between sheets".

Japanese Unexamined Patent Application Publication No. 2000-206744 discloses an image forming apparatus that prevents image quality defects such as inconsistencies in image density and fogging. In the technology disclosed in Japanese Unexamined Patent Application Publication No. 2000-206744, before formation of an electrostatic latent image, the image density of an image formed on an image carrying member is detected, and when the detection value is determined to be lower than a desired value, a predetermined electrostatic latent image is formed to forcefully consume a developer in a development device.

Japanese Unexamined Patent Application Publication No. 2003-76079 discloses an image forming apparatus that removes a failure caused by the degradation of a developer when a development device is driven in a state where a small amount of toner is consumed. In the technology disclosed in Japanese Unexamined Patent Application Publication No. 2003-76079, the area ratio of an image formed and the development drive time of a development device are detected, and a developer is forcefully consumed according to the image area ratio per unit drive time of the development.

Japanese Unexamined Patent Application Publication No. 2005-43388 discloses a technology that prevents failures such as the lowering of image quality caused by the fatigue/degradation of a developer. In the technology disclosed in Japanese Unexamined Patent Application Publication No. 2005-43388, an image area ratio per unit movement distance of a developer carrying member is detected, and based on the result of the detection, the forced consumption of toner is controlled.

When the region between sheets is prolonged to some degree such as by a post-processing machine operation, the wait of insert paper or the wait of a machine on one side in a series tandem, the photosensitive member is idled therebetween, and the lubricant is supplied from the development device to the photosensitive member in a state where an extremely small amount of toner is supplied. Hence, in such a case, after the start of the drawing of the RFP (low production-time forced discharge toner image) (the formation of the first RFP), for example, the RFP is periodically formed.

Here, consideration will be given to timing at which the RFP is drawn. Since under conditions in which the image formation processing of low coverage has been performed, it is assumed that the lubricant in the development device has already been reduced considerably, it is preferable to draw the RFP earlier.

However, under conditions in which the image formation processing of high coverage has been performed, as compared with the conditions in which the image formation processing of low coverage has been performed, it is assumed that the lubricant is less reduced, and even if the RFP is drawn relatively late, it is possible to maintain the appropriate application of the lubricant to the photosensitive member. As described above, the RFP is drawn late, and thus the consumed amount of toner is reduced accordingly.

In view of the foregoing conditions, the present invention has an object to provide an image forming apparatus and a control method that can achieve both a reduction in the consumed amount of toner and the appropriate application of the lubricant to the photosensitive member.

SUMMARY OF THE INVENTION

According to the present invention, there is provided an image forming apparatus that supplies, to an image carrying member, a toner to which a lubricant is externally added to form a toner image and that transfers the toner image to a sheet transported to the image carrying member, the image forming apparatus including a control portion that controls, when a toner patch is formed onto the image carrying member in a part corresponding to a region between the sheets transported continuously, the drawing of the toner patch based on coverage information of the toner image transferred to the sheet transported in a predetermined period. The "toner patch" here is not particularly limited to a specific form such as a shape and is a conception including a RFP.

More specifically, in the configuration described above, the control portion may perform control such that when the value of the coverage information is higher, start of the drawing of the toner patch is delayed. More specifically, in the configuration described above, the control portion may form, after the start of the drawing of the toner patch, the toner patch such that a constant amount of toner is consumed at a regular interval.

More specifically, in the configuration described above, the control portion may be configured so as not to form the toner patch when the length of the region between the sheets is less than a predetermined lower limit value. More specifically, in the configuration described above, the image carrying member may be a rotating photosensitive drum, and the control portion may stop the rotation of the photosensitive drum when the length of the region between the sheets exceeds a predetermined upper limit value.

According to the present invention, there is provided a control method performed by an image forming apparatus that supplies, to an image carrying member, a toner to which a lubricant is externally added to form a toner image and that transfers the toner image to a sheet transported to the image carrying member, where when a toner patch is formed onto the image carrying member in a part corresponding to a region between the sheets transported continuously, the drawing of the toner patch is controlled based on coverage information of the toner image transferred to the sheet transported in a predetermined period.

In the control method described above, when the value of the coverage information is higher, the start of the drawing of the toner patch may be delayed.

In the control method described above, after the start of the drawing of the toner patch, the toner patch may be formed such that a constant amount of toner is consumed at a regular interval.

The control method described above may be configured such that the toner patch is not formed when the length of the region between the sheets is less than a predetermined lower limit value.

In the control method described above, the image carrying member may be a rotating photosensitive drum, and the rotation of the photosensitive drum may be stopped when the length of the region between the sheets exceeds a predetermined upper limit value.

BRIEF DESCRIPTION OF THE DRAWINGS

FIG. 1 A block diagram showing a schematic configuration of an image forming apparatus according to the present embodiment;

FIG. 2 A diagram of the configuration of an image formation transfer portion according to the present embodiment;

FIG. 3 An illustrative diagram of the form of a RFP in the present embodiment;

FIG. 4 A flowchart on control on the formation of the RFP in a comparative example;

FIG. 5 An illustrative diagram of the form of the formation of the RFP in the comparative example;

FIG. 6 A flowchart on control on the formation of the RFP in the present embodiment;

FIG. 7 An illustrative diagram of the form of the formation of the RFP in the present embodiment; and FIG. 8 An illustrative diagram of the change of the amount of lubricant by control in the present embodiment.

DESCRIPTION OF PREFERRED EMBODIMENTS

An embodiment of the present invention will be described below with reference to drawings. However, the details of the present invention are not limited to the embodiment.

[Configuration and the Like of Image Forming Apparatus]

FIG. 1 is a block diagram showing a schematic configuration of an image forming apparatus X according to the present embodiment. As shown in the figure, the image forming apparatus X includes a paper feed portion 1, an image formation transfer portion 2, a fixing portion 3 and a control portion 4. The image forming apparatus X is an electrophotographic image forming apparatus (for example, a printer), and receives, as its basic operation, an input of image data from the outside (for example, a PC), prints an image on a sheet and ejects it to the outside.

The paper feed portion 1 includes a tray in which sheets are stored and the like, and supplies a sheet to the image formation transfer portion 2 with timing at which a toner image is transferred. The image formation transfer portion 2 performs processing (image formation processing) for producing the toner image based on the image data received and processing (transfer processing) for transferring the toner image to the sheet. The sheet to which the toner image is transferred by the image formation transfer portion 2 is transported to the fixing portion 3.

The fixing portion 3 plays a role in fixing, to the sheet, the toner image transferred to the sheet. Printing is achieved by the fixing of the toner image, and the sheet on which the fixing has been completed (the printing has been completed) is ejected from the image forming apparatus X to the outside. The control portion 4 is formed with, for example, a CPU, and controls the individual portions of the image forming apparatus X.

The specific configuration of the image formation transfer portion 2 will then be described with reference to FIG. 2. In FIG. 2, a photosensitive drum (one form of an image carrying member) 211 is a rotatable member that carries the toner image. Along the direction of rotation (direction indicated by an arrow) of the photosensitive drum 211, a charging device 212, an exposure device 213, a development device 214, a transfer belt 215 that transfers the toner image formed on the photosensitive drum 211 to the sheet S, a PCC (Pre-Cleaning Corotron) 216 and a cleaning device 217 (including a brush 217*a* and a blade 217*b*) that removes the toner left on the photosensitive drum 211 are provided.

The charging device 212 uniformly charges the surface of the photosensitive drum 211 having photoconductivity so as to have negative polarity. The exposure device 213 is formed with, for example, a semiconductor laser, and applies laser light corresponding to the image to the photosensitive drum 211. In the charge generation layer of the photosensitive drum 211, positive charge is generated and is transported to the surface of a charge transport layer, and thus the charge (negative charge) on the surface of the photosensitive drum 211 is neutralized. On the surface of the photosensitive drum 211, an electrostatic latent image is formed by a potential difference with respect to the surrounding area.

The development device 214 is, for example, a development device of a two-component development system, and attaches the toner to the surface of the photosensitive drum 211 and thereby visualizes the electrostatic latent image to form the toner image (development operation). Toner corresponding to the toner consumed by the development operation is supplied from an unillustrated toner supply mechanism.

The transfer belt 215 has a structure formed with two layers, namely, a semiconductive belt base member formed of chloroprene rubber or the like and an insulting layer provided as a surface layer. The transfer belt 215 is strung between a driven roller 223, a drive roller 222 and other rollers, and is arranged below the photosensitive drum 211 such that the surface of the transfer belt 215 makes contact with part of the outer circumferential surface of the photosensitive drum 211. In other words, between the transfer belt 215 and the photosensitive drum 211, a transfer nip portion serving as a transfer region is formed. In the transfer nip portion, the sheet S is transported while being pressed onto the photosensitive drum 211 by the transfer belt 215.

Inside the transfer belt 215 which makes contact with part of the outer circumferential surface of the photosensitive drum 211, a transfer roller 220 is arranged. A high-voltage power supply (not shown) for applying a transfer bias is connected to the transfer roller 220. The control portion 4 (shown in FIG. 1) controls the transfer bias which needs to be applied by the high-voltage power supply such that when the sheet S is passed through the transfer nip portion, the transfer roller 220 has a predetermined transfer potential (positive polarity). The transfer roller 220 has the transfer potential of positive polarity, and thus the toner image of negative polarity on the photosensitive drum 211 is transferred to the sheet S in contact with the photosensitive drum 211.

The control portion 4 also controls the transfer bias which needs to be applied by the high-voltage power supply such that when the sheet S is not passed through the transfer nip portion, the transfer roller 220 has a predetermined transfer potential (negative polarity). In terms of reducing the power consumption of the high-voltage power supply, the control portion 4 may control the high-voltage power supply such that when the sheet S is not passed through the transfer nip portion, the transfer bias is not applied to the transfer roller 220.

The PCC 216 removes unnecessary residual charge on the photosensitive drum 211. The cleaning device 217 plays a role in removing (cleaning) attachments such as the residual toner attached to the surface of the photosensitive drum 211 after the transfer. The developer of the present embodiment contains the toner to which a lubricant is externally added, and the toner is supplied from the development device 214 onto the photosensitive drum 211 to form (develop) the toner image. Then, after the toner image is transferred to the sheet, the lubricant left on the photosensitive drum 211 is leveled off with the blade 217*b*, and thus the lubricant is appropriately supplied onto the photosensitive drum 211.

The attached amount of lubricant on the surface of the photosensitive drum 211 greatly affects the cleaning performance. For example, when the attached amount of lubricant is decreased, since the residual toner or the like is easily attached to the surface of the photosensitive drum 211, it becomes difficult to perform the cleaning, with the phenomenon that the toner is passed through or an edge part of the blade 217*b* is drawn in the direction of movement (the direction of rotation) of the photosensitive drum 211 and is thereby turned up.

Here, the case where the attached amount of lubricant is decreased will be specifically described. The lubricant externally added to the toner has an opposite polarity (for example, a positive polarity) so as to be attached to the toner, and a large proportion of the lubricant is moved to a part (negatively charged white part) of the surface of the photosensitive drum 211 that is not exposed at the time of development operation by the development device 214.

Hence, when the image formation processing of low coverage (for example, 3.5% or less) is continuously performed, in a state where a small amount of toner is supplied to the development device 214, a large amount of lubricant is moved from the development device 214 to the photosensitive drum 211 as compared with the toner, with the result that the lubricant in the development device 214 may be exhausted.

When a region between sheets is prolonged to some degree, and the photosensitive drum 211 is idled, the lubricant is moved from the development device 214 to the photosensitive drum 211, with the result that the lubricant in the development device 214 may be exhausted. When the lubricant in the development device 214 is exhausted, the lubricant to be attached to the photosensitive member 211 runs out, and thus the amount of lubricant on the photosensitive drum 211 is gradually lowered, with the result that the phenomenon described above occurs.

Therefore, the control portion 4 controls the image formation transfer portion 2 such that a RFP s formed in the non-image formation region (region between sheets) of the photosensitive drum 211 to newly supply the toner to which the lubricant is externally added to the development device 214. The non-image formation region (region between sheets) is a part that corresponds to a region between sheets which are continuously transported. The RFP is one form of a toner patch.

FIG. 3 shows the form of the RFP in the present embodiment. As shown in the figure, the RFP is a belt-shaped toner image that extends so as to perpendicularly intersect the direction of movement (direction of rotation) of the photosensitive drum 211 between the sheets. The interval L between the back end of the sheet (in the following description, also referred to as a "front sheet") immediately ahead of the RFP and the RFP can be set at, for example, 35 m sec.

As the coverage of a toner image formed most immediately is lower, the width D of the RFP may be set wider. This is because as the coverage of a toner image formed is lower, the possibility that the lubricant in the development device 214 is exhausted is increased, and thus it is necessary to supply, to the development device 214, a larger amount of toner to which the lubricant is externally added. As the specific shape and the like of the RFP, other forms may be adopted.

Now consider the case where the region between sheets is prolonged to some degree such as by a post-processing machine operation, the wait of insert paper or the wait of a machine on one side in a series tandem. In this case, in the region between sheets, the photosensitive drum 211 is idled, and while an extremely small amount of toner is being supplied, the lubricant is supplied from the development device 214 to the photosensitive drum 211. Hence, in the present embodiment, even in such a case, after the start of the drawing of the RFP (the formation of the first RFP), the RFP is periodically formed such that the amount of lubricant in the development device 214 is appropriately maintained.

Furthermore, in the present embodiment, based on the coverage of the toner image transferred to a sheet transported within a predetermined immediate period including the front sheet, the position in which the RFP is drawn is adjusted. Since the rotation speed of the photosensitive drum 211 is basically constant, the adjustment of the position in which the RFP is drawn basically has the same meaning as the adjustment of timing at which the RFP is drawn.

In the present embodiment in which the adjustment described above is performed, regardless of the coverage of the toner image on up to the front sheet, as compared with a form (hereinafter, this form is assumed to be a "comparative example") in which the position where the RFP is drawn remains the same, while the appropriate application of the lubricant to the photosensitive drum 211 is maintained, it is possible to reduce the consumed amount of toner. In order to more clarify this point, control on the formation of the RFP in the present embodiment and the comparative example will be specifically described below.

[Control on Formation of RFP in Comparative Example]

Control on the formation of the RFP in the comparative example will first be described. FIG. 4 is a flowchart on the control on the formation of the RFP in the comparative example. As shown in the figure, in the comparative example, whether or not the length of the region between sheets is equal to or more than 200 mm (an example of the lower limit value) is determined (step S11), and when the length of the region between sheets is less than 200 mm (no in step S11), the RFP is not produced (step S12) whereas when the length of the region between sheets is equal to or more than 200 mm (yes in step S11), the RFP is produced (step S13). As described above, although in the comparative example, whether or not the RFP is formed is switched according to the length of the region between sheets such that when the region between sheets is excessively short, the RFP is not formed, the position in which the RFP is drawn remains the same.

FIG. 5 schematically shows how the RFP is formed when the length of the region between sheets is equal to or more than 200 mm in the comparative example. The upper stage of FIG. 5 shows a case (for example, at the time of an average print rate of 3%) where the toner image on up to the front sheet has low coverage, and the lower stage shows a case (for example, at the time of an average print rate of 6%) where the toner image on up to the front sheet has high coverage.

As shown in the figure, since in the comparative example, regardless of the coverage of the toner image on up to the front sheet, the position in which the RFP is drawn remains the same, when the position in which the RFP is drawn is set according to low coverage, in the case of high coverage, the position in which the RFP is drawn is located on the front side more than necessary. Specifically, although in the case of high coverage, for example, as shown in the lower stage of FIG. 5, the preceding three rounds of RFP are not actually needed, the three rounds of RFP are formed. It can be considered that in the comparative example, these unnecessary rounds of RFP are formed, and that the toner is wasted accordingly.

[Control on Formation of RFP in Present Embodiment]

Control on the formation of the RFP in the present embodiment will then be described. FIG. 6 is a flowchart on the control on the formation of the RFP in the present embodiment. The control portion 4 of the present embodiment determines whether or not the length of the region between sheets is equal to or more than 200 mm (an example of the lower limit value) (step S21), and when the length of the region between sheets is less than 200 mm (no in step S21), the RFP is not produced (step S22). The present embodiment is the same as the comparative example in this point.

When the length of the region between sheets is equal to or more than 200 mm (yes in step S21), the control portion 4 determines whether or not the length of the region between sheets exceeds a predetermined upper limit value $\alpha$ (for example, 600 mm), and when the length of the region between sheets exceeds the upper limit value $\alpha$ (yes in step S23), the photosensitive drum 211 is stopped (step S24). As described above, when it is previously found that the length of the region between sheets exceeds the upper limit value $\alpha$, the rotation of the photosensitive drum 211 is stopped (the image formation is stopped), and thus the movement of the lubricant from the development device 214 to the photosensitive drum 211 is reduced, with the result that it is not necessary to form the RFP to reduce the consumption of the toner.

When the length of the region between sheets is less than the upper limit value $\alpha$ (no in step S23), the control portion 4 performs control such that based on the coverage information (in the present embodiment, the average print rate) of the toner image on up to the front sheet, the RFP is drawn (steps S25 to S31). The coverage information is information indicating the coverage of a toner image formed within a predetermined immediate period, and is, for example, the average print rate of sheets included within the predetermined immediate period including the front sheet. The coverage information may be the print rate (coverage) of an original document that is calculated by the amount of image (the number of pixels) produced in a certain period (for example, a period of 30 sec. updated every 15 sec.) and the drive distance (which can be replaced with a development drive time) of the photosensitive drum 211.

Processing in step S25 and the subsequent steps will be specifically described. When the average print rate is equal to or less than 3.5% (yes in step S25), the control portion 4 sets the position in which the RFP is drawn at a position 150 mm away from the back end of the front sheet (step S26). When the average print rate exceeds 3.5% but is equal to or less than 5% (yes in step S27), the control portion 4 sets the position in which the RFP is drawn at a position 300 mm away from the back end of the front sheet (step S28). When the average print rate exceeds 5% but is equal to or less than 7% (yes in step S29), the control portion 4 sets the position in which the RFP is drawn at a position 400 mm away from the back end of the front sheet (step S30). When the average print rate exceeds 7% (no in step S29), the control portion 4 sets the position in which the RFP is drawn at a position 500 mm away from the back end of the front sheet (step S31). By the control as described above, the position in which the RFP is drawn in the present embodiment is set according to the average print rate (coverage) as indicated in table 1.

TABLE 1

| Average print rate (coverage) | Position in which RFP is drawn |
|---|---|
| 3.5% or less | 150 mm away from back end of front sheet |
| 5% or less | 300 mm away from back end of front sheet |
| 7% or less | 400 mm away from back end of front sheet |
| more than 7% | 500 mm away from back end of front sheet |

FIG. 7 schematically shows how the RFP is formed when the length of the region between sheets is equal to or more than 200 mm in the present embodiment. The upper stage of FIG. 7 shows a case (for example, at the time of an average print rate of 3%) where the toner image on up to the front sheet has low coverage, and the lower stage shows a case (for example, at the time of an average print rate of 6%) where the toner image on up to the front sheet has high coverage.

In the present embodiment, as the value of the coverage information of the toner image on up to the front sheet is higher, the position in which the RFP is drawn is displaced backward (in other words, the timing at which the RFP is drawn is delayed). Hence as shown in FIG. 7, the formation (see FIG. 5) of the unnecessary three rounds of RFP occurring in the comparative example is omitted, and the consumption of the toner is reduced accordingly.

Preferably, a specific correspondence relationship between the coverage information and the position in which the RFP is drawn and the like are previously set appropriate such that the amount of lubricant in the developer is maintained to be appropriate. The control portion 4 may have information on the correspondence relationship as table information or may use a predetermined relational formula to calculate the position in which the RFP is drawn from the coverage information at any time.

FIG. 8 schematically shows the change of the amount of lubricant (the amount of lubricant in the development device 214) in the developer by the control in the present embodiment. As shown in the figure, as the average print rate (coverage information) of up to the front sheet is higher, the amount of lubricant in the developer in the early stage of the region between sheets is increased. Hence, as the average print rate is higher, even when the timing at which the RFP is drawn is delayed, the amount of lubricant in the developer is prevented from significantly dropping below (excessively being lowered than) an appropriate amount (that is assumed to be the amount of lubricant at the time of 3.5% toner discharge in the case of FIG. 8).

As shown in FIG. 8, in the present embodiment, the RFP is drawn immediately before the amount of lubricant in the developer is excessively lowered, and after the drawing, the RFP is formed such that a constant amount of toner is consumed at a regular interval. In this way, it is possible to appropriately apply the lubricant to the photosensitive drum 211 while reducing the consumed amount of toner as much as possible.

As described above, the image forming apparatus X of the present embodiment supplies the toner to which the lubricant is externally added to the photosensitive drum 211 to form a toner image, and transfers the toner image to a sheet transported to the photosensitive drum 211.

Furthermore, the control portion 4 included in the image forming apparatus X controls, when a RFP (toner patch) is formed onto the photosensitive drum 211 in a part corresponding to a region between sheets transported continuously, the drawing of the RFP based on the coverage information of the toner image transferred to the sheets transported in a predetermined period. Hence, with the image forming apparatus X, it is possible to both reduce the consumed amount of toner and appropriately apply the lubricant to the photosensitive drum 211.

Although the embodiment of the present invention is described above using the specific examples, the present invention is not limited to the details thereof. The present invention can be practiced in various specific aspects without departing from the spirit thereof.

What is claimed is:

1. An image forming apparatus that supplies, to an image carrying member, a toner to which a lubricant is added to form a toner image and that transfers the toner image to a sheet transported to the image carrying member, the image forming apparatus comprising:

a control portion that controls, when a plurality of toner patches is formed onto the image carrying member in a non-image formation region corresponding to a region between two sheets transported continuously to the image carrying member, an interval between a front toner patch among the plurality of toner patches and a back end of one of the sheets immediately ahead of the front toner patch the control of the interval being based on coverage information of the toner image formed within a predetermined period, the interval defining a start of drawing of the plurality of toner patches, wherein the plurality of toner patches includes a numerical quantity of the toner patches, the control portion performs control such that when a value of the coverage information is higher, the start of the drawing of the plurality of toner patches is delayed and the numerical quantity of the toner patches is reduced.

2. The image forming apparatus according to claim 1, wherein the control portion forms, after start of the drawing of the plurality of toner patches the plurality of toner patches such that a constant amount of toner is consumed at a regular interval.

3. The image forming apparatus according to claim 1, wherein the control portion does not form the plurality of toner patches when a length of the region between the sheets is less than a predetermined lower limit value.

4. The image forming apparatus according to claim 1, wherein the image carrying member is a rotating photosensitive member, and the control portion stops the rotation of the photosensitive member when a length of the region between the sheets exceeds a predetermined upper limit value.

5. A control method performed by an image forming apparatus that supplies, to an image carrying member, a toner to which a lubricant is added to form a toner image and that transfers the toner image to a sheet transported to the image carrying member, the method comprising:

forming a plurality of toner patches onto the image carrying member in a non-image formation region corresponding to a region between two sheets transported continuously to the image carrying member, wherein when the plurality of toner patches is formed, controlling an interval between a front toner patch among the plurality of toner patches and a back end of one of the sheets immediately ahead of the front toner patch, the control of the interval is based on coverage information of the toner image formed within a predetermined period, and wherein the interval defines a start of drawing of the plurality of toner patches, wherein the plurality of toner patches includes a numerical quantity of the toner patches, and the controlling is performed such that when a value of the coverage information is higher, the start of the drawing of the plurality of toner patches is delayed and the numerical quantity of the toner patches is reduced.

6. The control method according to claim 5, wherein after start of the drawing of the plurality of toner patches the plurality of toner patches is formed such that a constant amount of toner is consumed at a regular interval.

7. The control method according to claim 5, wherein the plurality of toner patches is not formed when a length of the region between the sheets is less than a predetermined lower limit value.

8. The control method according to claim 5, wherein the image carrying member is a rotating photosensitive member, and the rotation of the photosensitive member is stopped when a length of the region between the sheets exceeds a predetermined upper limit value.

9. The image forming apparatus according to claim 1, wherein the control portion changes a start position of the plurality of toner patches based on the coverage information of the toner image within the predetermined period.

10. The image forming apparatus according to claim 1, wherein the coverage information is information indicating the coverage of the toner image transferred to the sheet transported in the predetermined period.

11. The image forming apparatus according to claim 1, wherein the plurality of toner patches is applied on an area of the image carrying member and the lubricant moves to another area of the image carrying member on which the plurality of toner patches is not applied.

12. The control method according to claim 5, wherein a start position of the plurality of toner patches is controlled based on the coverage information of the toner image within the predetermined period when the plurality of toner patches is formed.

13. The control method according to claim 5, wherein the coverage information is information indicating the coverage of the toner image transferred to the sheet transported in the predetermined period.

14. The control method according to claim 5, wherein the plurality of toner patches is applied on an area of the image carrying member and the lubricant moves to another area of the image carrying member on which the plurality of toner patches is not applied.

* * * * *